US009334766B2

(12) United States Patent
Mordukhovich

(10) Patent No.: US 9,334,766 B2
(45) Date of Patent: May 10, 2016

(54) METHOD AND APPARATUS FOR CONTROLLING OIL FLOW IN AN INTERNAL COMBUSTION ENGINE

(75) Inventor: Gregory Mordukhovich, Bloomfield Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 272 days.

(21) Appl. No.: 13/245,910

(22) Filed: Sep. 27, 2011

(65) Prior Publication Data

US 2013/0074797 A1 Mar. 28, 2013

(51) Int. Cl.
*F01M 1/00* (2006.01)
*F01M 1/16* (2006.01)
*F01M 1/08* (2006.01)

(52) U.S. Cl.
CPC .. *F01M 1/16* (2013.01); *F01M 1/08* (2013.01)

(58) Field of Classification Search
CPC ... F01P 2003/006; F01P 3/08; F01P 2060/04; F01P 7/00
USPC ..... 123/196 R, 196 AB, 196 M, 41.05, 123/41.064, 41.73, 41.42
See application file for complete search history.

(56) References Cited

U.S. PATENT DOCUMENTS 3,485,324 A * 12/1969 Novak ..... 184/6
4,142,676 A 3/1979 Hattori
4,399,774 A * 8/1983 Tsutsumi ..... 123/41.1
4,542,719 A * 9/1985 Wilkinson ..... 123/41.35
4,667,630 A * 5/1987 Sasaki ..... 123/254
4,890,695 A 1/1990 Morris et al.
5,517,959 A * 5/1996 Kato et al. ..... 123/196 AB
5,819,692 A * 10/1998 Schafer ..... 123/41.35
6,955,142 B2 10/2005 Patel et al.
7,249,577 B1 7/2007 Zhang et al.
7,827,942 B2 11/2010 Hisatomi
2003/0200958 A1* 10/2003 Ito et al. ..... 123/520
2003/0230274 A1 12/2003 Williams et al.
2004/0226613 A1* 11/2004 Ono ..... 137/468
2005/0120982 A1* 6/2005 Ducu ..... 123/41.08
2006/0011159 A1* 1/2006 Bloms et al. ..... 123/90.12
2006/0016429 A1* 1/2006 Mashiki ..... 123/431
2006/0065218 A1* 3/2006 Gokan et al. ..... 123/41.82 R
2009/0044768 A1 2/2009 Arvan et al.
2009/0229561 A1* 9/2009 Yamashita et al. ..... 123/196 R
2009/0311115 A1* 12/2009 Ono et al. ..... 417/279
2010/0031917 A1* 2/2010 Abe ..... 123/197.2
2010/0031971 A1* 2/2010 Ha ..... 132/293
2011/0066357 A1* 3/2011 Rollinger et al. ..... 701/105
2011/0144882 A1* 6/2011 Bidner et al. ..... 701/102
2011/0308912 A1* 12/2011 Kimura et al. ..... 192/113.3
2012/0132172 A1* 5/2012 Kobayashi et al. ..... 123/196 R

* cited by examiner

*Primary Examiner* — Lindsay Low
*Assistant Examiner* — Long T Tran

(57) ABSTRACT

A lubrication system for an internal combustion engine includes an oil jet configured to communicate oil onto an internal engine surface. The oil jet is fluidly connected to a pressurized oil source via an oil flow controller that is configured to control oil flowrate to the oil jet in response to a temperature of the internal engine surface.

16 Claims, 2 Drawing Sheets

METHOD AND APPARATUS FOR CONTROLLING OIL FLOW IN AN INTERNAL COMBUSTION ENGINE

TECHNICAL FIELD

This disclosure is related to oil flow in internal combustion engines.

BACKGROUND

The statements in this section merely provide background information related to the present disclosure. Accordingly, such statements are not intended to constitute an admission of prior art.

Lubrication systems for internal combustion engines may employ piston jets configured to direct flow of pressurized engine oil onto undersides of pistons to dissipate piston heat and provide cylinder wall lubrication. Systems supplying pressurized oil flow to piston jets include oil pumps having oil flowrates that are controlled in response to engine speed and load. Such systems may include valves configured to disable or minimize oil flow to piston jets at low speed/load conditions. Applying excess oil to engine pistons and cylinder walls may result in increased exhaust emissions due to combustion of the excess oil. Applying excess oil to engine pistons and cylinder walls may cause increased friction between a cylinder liner and piston rings, affecting fuel consumption and startability.

SUMMARY

A lubrication system for an internal combustion engine includes an oil jet configured to communicate oil onto an internal engine surface. The oil jet is fluidly connected to a pressurized oil source via an oil flow controller that is configured to control oil flowrate to the oil jet in response to a temperature of the internal engine surface.

BRIEF DESCRIPTION OF THE DRAWINGS

One or more embodiments will now be described, by way of example, with reference to the accompanying drawings, in which.

DETAILED DESCRIPTION

Figure 1:
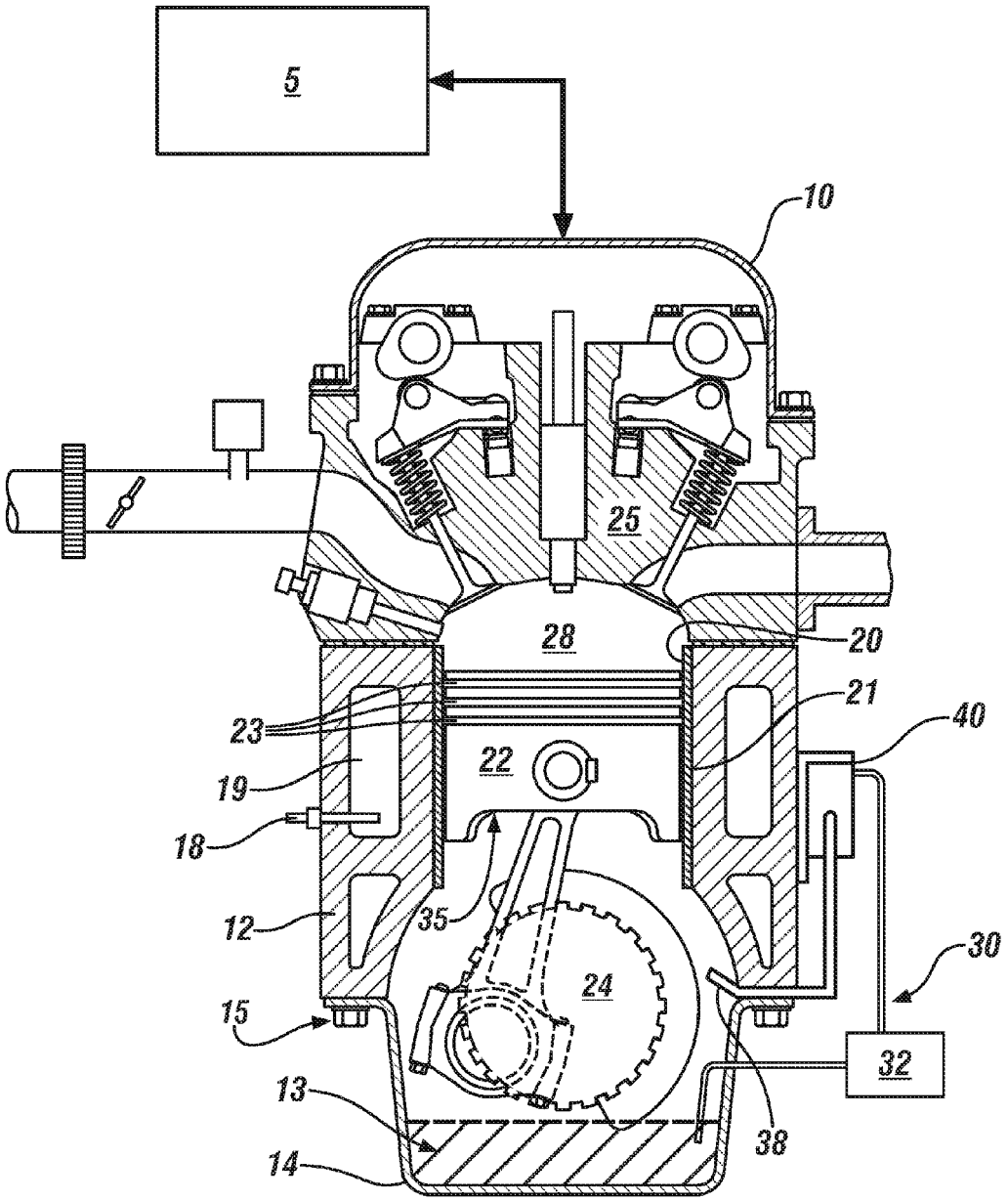
FIG. 1 is a schematic diagram of an internal combustion engine, in accordance with the disclosure.

Referring now to the drawings, wherein the showings are for the purpose of illustrating certain exemplary embodiments only and not for the purpose of limiting the same, FIG. 1 is a schematic diagram of an internal combustion engine 10 in accordance with the present disclosure. The exemplary engine 10 may be any suitable multi-cylinder internal combustion engine. The engine 10 includes an engine block 12 and a cylinder head 25. The engine block 12 includes a plurality of cylinders 20 formed therein and a plurality of internal voids forming coolant passageways 19. Walls 21 of each of the cylinders 20 may include a cylinder liner. Each of the cylinders 20 accommodates a reciprocating piston 22 that attaches to a crankshaft 24. The crankshaft 24 mechanically couples to a vehicle transmission and driveline to deliver tractive torque thereto in response to an operator torque request. The crankshaft 24 rotatably attaches to a lower portion 15 of the engine block 12 using main bearings. An oil pan 14 attaches to the lower portion 15 of the engine block 12 and encases the crankshaft 24 and the lower portion 15 of the engine block 12. The oil pan 14 includes an oil sump area 13 for storing and collecting engine oil that drains from the engine 10.

The engine 10 includes a plurality of variable-volume combustion chambers 28, a single one of which is illustrated. The combustion chamber 28 is defined by the piston 22, the cylinder wall 21, and the cylinder head 25, with the variable volume determined in relation to reciprocating movement of the piston 22 within the cylinder 20 between top-dead-center and bottom-dead-center points. The engine 10 preferably employs a four-stroke operation with repetitive combustion cycles including 720 degrees of angular rotation of the crankshaft 24 that are divided into four 180-degree strokes including intake-compression-expansion-exhaust associated with the reciprocating movements of the piston 22 in the engine cylinder 20.

The engine 10 includes sensing devices to monitor engine operation, including, e.g., a coolant temperature sensor 18. The engine 10 includes actuators to control engine operation. The sensing devices and actuators are signally or operatively connected to a control module 5. The exemplary engine 10 is depicted as a direct-injection spark ignition engine, but the disclosure is not intended to be limited thereto.

The engine 10 may be configured to operate in one of a plurality of operating modes during vehicle operation including an all-cylinder mode, a cylinder deactivation mode, a deceleration fuel cutoff (DFCO) mode, and an autostop mode. All available engine cylinders are fueled and firing to generate torque when operating in the all-cylinder mode. A portion of the available engine cylinders are fueled and firing and the other available engine cylinders are unfueled and thus not firing when operating in the cylinder deactivation mode. All of the available engine cylinders are unfueled and thus not firing and the engine 10 is rotating when operating in the fuel cutoff mode, e.g., in response to a deceleration event. All of the engine cylinders are unfueled and the engine 10 is not rotating when in the autostop mode.

The engine 10 includes a lubrication system 30 employing an oil pump 32 that fluidly connects to a temperature-responsive oil flow controller 40 that is fluidly connected to a single one or a plurality of oil jet(s) 38 configured to spray pressurized oil onto internal engine surfaces 35. The lubrication system 30 including the oil pump 32 fluidly connected to the temperature-responsive oil flow controller 40 as shown are for ease of illustration, and may be suitably located within the lower portion 15 of the engine block 12 and oil pan 14. In one embodiment the oil pump 32 channels pressurized oil drawn from the sump 13 to the oil jet(s) 38 via the oil flow controller 40. In one embodiment, the pressurized oil is sprayed onto the internal engine surface 35 to dissipate heat therefrom, with a secondary effect of lubricating the various rotating and translating engine components. In one embodiment, the internal engine surface 35 includes underside portions of the pistons 22. The internal engine surface 35 may include other engine components without limitation. In one embodiment, the oil jet(s) 38 is a piston cooling jet positioned within the lower portion 15 of the engine block 12.

The oil flow controller 40 is configured to control flowrate of pressurized oil to one or a plurality of the oil jet(s) 38 in response to temperature(s) that correlates to temperature of the internal engine surface 35 on which the oil jet(s) 38 sprays engine oil. Temperatures that correlate to temperature of the internal engine surface 35 include a temperature on the cylinder wall 21, a temperature at a bearing surface, a combustion blow-by gas temperature, oil temperature, coolant temperature, or another suitable engine temperature. A temperature that correlates to the temperature of the internal engine surface 35 may serve as a proxy for the temperature of the internal engine surface 35.

The temperature of the internal engine surface 35 is affected by operation of the engine 10 and the specific cylinder(s) associated with the oil flow controller 40 and corresponding oil jet(s) 38. Specific engine-related parameters affecting the temperature of the internal engine surface 35 may include engine speed, engine load, operation of cylinder deactivation, oil temperature, coolant temperature, ambient environment temperature, and geometric configurations of the engine block and the specific cylinder(s). The oil flow controller 40 may be configured to control the oil flowrate to the oil jet(s) 38 in response to the temperature of the internal engine surface 35, with engine oil temperature serving as a proxy for the temperature of the internal engine surface 35 in one embodiment. The oil flow controller 40 may be configured to control the oil flowrate to the oil jet(s) 38 in response to the temperature of the internal engine surface 35, with engine block temperature serving as a proxy for the temperature of the internal engine surface 35 in one embodiment. The oil flow controller 40 may be configured to control the oil flowrate to the oil jet(s) 38 in response to the temperature of the internal engine surface 35, with the engine block temperature and the engine oil temperature used as proxies for the temperature of the internal engine surface 35 in one embodiment.

Controlling the oil flowrate to the oil jet(s) 38 includes increasing the oil flowrate to the oil jet(s) 38 with increasing temperature of the internal engine surface 35. This includes providing a maximum oil flowrate to the oil jet(s) 38 when the temperature of the internal engine surface 35 is at its greatest design temperature, and providing reduced oil flowrates at lower temperatures of the internal engine surface 35. It is appreciated that the reduced oil flowrates provided at the lower temperature of the internal engine surface 35 are sufficient to lubricate the affected frictional interfaces within the engine 10. It is appreciated that providing reduced oil flowrates at lower temperature of the internal engine surface 35 may include discontinuing oil flow when a temperature of the internal engine surface 35 is below a threshold temperature.

The fluidic circuit for supplying oil to the oil jet(s) 38 includes the oil pump 32 fluidly connected to the oil flow controller 40 that is fluidly connected to the oil jet(s) 38. Preferably there is a single oil flow controller 40 fluidly connected to all the oil jet(s) 38. Other suitable configurations include a plurality of oil flow controllers 40 fluidly connected the oil jet(s) 38, which may be advantageously employed on systems using cylinder deactivation.

Figure 2:
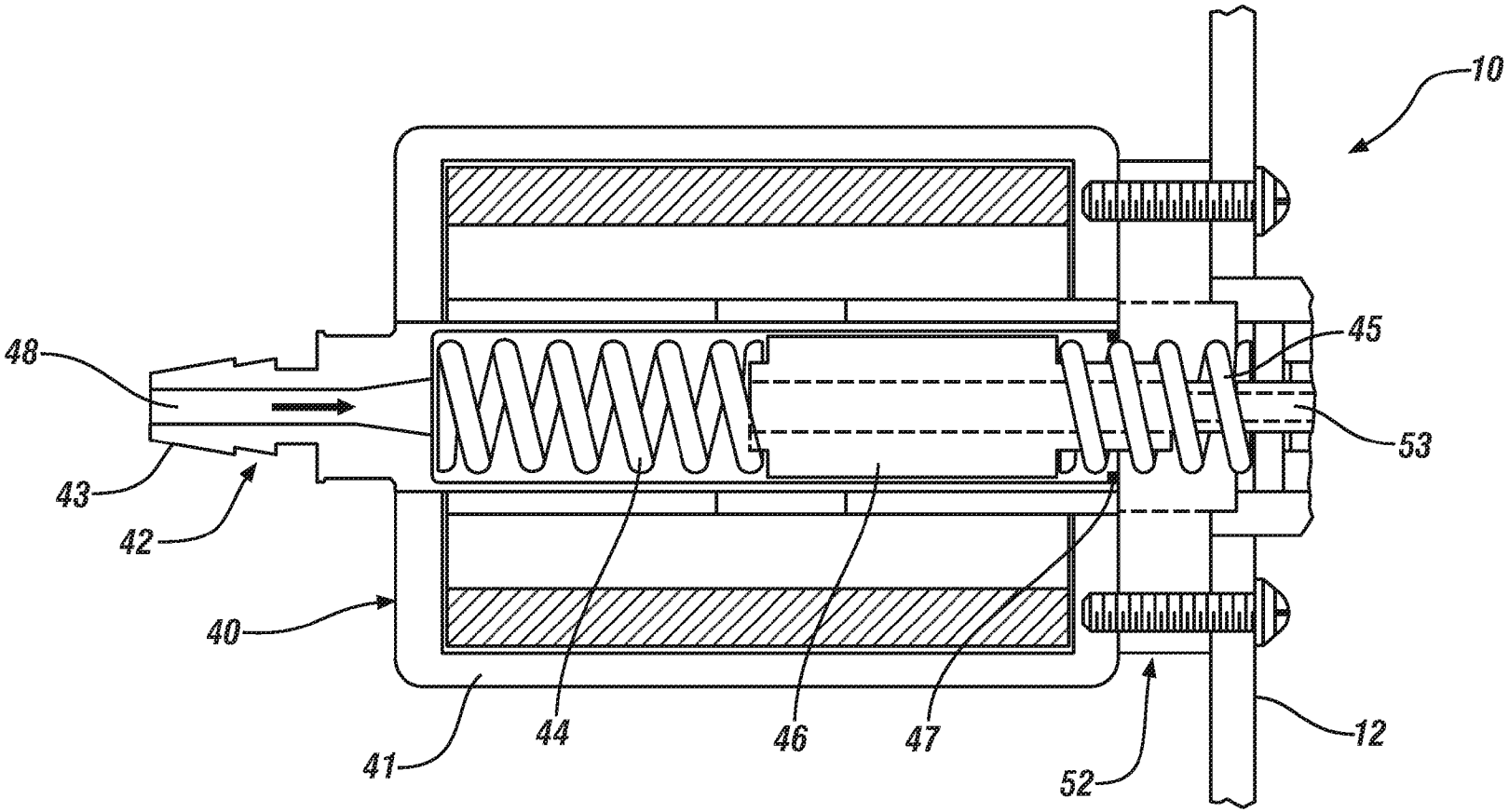
FIG. 2 is a schematic diagram of an exemplary temperature-responsive oil flow controller, in accordance with the disclosure.

FIG. 2 shows an exemplary embodiment of the temperature-responsive oil flow controller 40, which is a temperature-responsive oil flow control valve 40. The temperature-responsive oil flow control valve 40 is configured to variably control the flowrate of engine oil to the oil jet(s) 38 in response to the internal engine surface 35 that is indicated by proxy temperatures including the engine oil temperature and engine block temperature proximal to the oil flow control valve 40. Other suitable proxy temperatures for the temperature of the internal engine surface 35 may be used with similar effect. The oil flow control valve 40 is a thermo-sensitive valve configured for variable flowrate control in response to the engine oil temperature and the proximal engine block temperature. The oil flow control valve 40 includes a valve body 41 having a first end 42 including an inlet port 43 and a second end 52 including an outlet port 53. The inlet port 43 fluidly couples to the outlet port 53 via a flow channel 48. The inlet port 43 is in fluid communication with the oil pump 32, and the outlet port 53 is in fluid communication with all or a portion of the oil jet(s) 38. A plunger 46 is assembled within the flow channel 48, and is configured to interact with a valve seat 47. As shown, there is a first spring 44 positioned between the inlet port 43 and the plunger 46 and a second spring 45 positioned between the outlet port 53 and the plunger 46. The first spring 44 urges the plunger 46 towards the valve seat 47, and the second spring 45 urges the plunger 46 away from the valve seat 47. The first and second springs 44 and 45 are both preferably fabricated from suitable temperature-responsive bimetallic materials. Alternatively, the first spring 44 is fabricated from suitable spring materials and the second spring 45 is fabricated from suitable temperature-responsive bimetallic materials.

The second end 52 of the valve body 41 is preferably mechanically coupled to the engine block 12 of the engine 10 in a manner permitting heat conduction therebetween, which results in heat conduction to the second spring 45. The oil flow control valve 40 is thus able to control oil flow in response to oil temperature and engine block temperature. The first and second springs 44 and 45 are suitably calibrated to position the plunger 46 in relation to the valve seat 47 to permit a maximum oil flow to the associated oil jet(s) 38 only when the oil temperature and the engine block temperature indicate that the engine 10 is operating in conditions resulting in a relatively high temperature of the internal engine surface 35, e.g., high speed and high load conditions. The first and second springs 44 and 45 are further suitably calibrated to position the plunger 46 in relation to the valve seat 47 to meter oil flow to the oil jet(s) 38 to provide sufficient oil flow for engine lubrication when the oil temperature and engine block temperature indicate that the engine 10 is operating in conditions resulting in lower temperature of the internal engine surface 35. As such, an increasing temperature of the internal engine surface 35 results in an increased oil flowrate to the oil jet(s) 38 and a decreasing temperature of the internal engine surface 35 results in a decreased oil flowrate to the oil jet(s) 38.

Alternatively, the temperature-responsive oil flow control valve 40 is a thermo-sensitive oil flow control valve that is configured for discrete oil flow control in response to oil temperature and engine block temperature, with the oil flowrate enabled only when the oil temperature and the engine block temperature are greater than a composite threshold temperature. The temperature-responsive oil flow control valve 40 controls the oil flowrate at a preset flowrate when activated, with the oil flow control valve 40 only when the oil temperature and the engine block temperature are greater than the threshold temperature. Alternatively, the temperature-responsive oil flow controller 40 may be configured as a thermo-sensitive bimetal valve spring configured to activate a flow control valve element located in a flow channel proximal to each of the oil jets 38 to effect oil flow in response to a temperature of the internal engine surface 35. The temperature of the internal engine surface 35 may be represented by a proxy that includes a combination of oil pressure and oil temperature. Other embodiments of a temperature-responsive oil flow control valve 40 may be employed without limitation.

Controlling the oil flowrate to the oil jet(s) 38 in response to temperature of the internal engine surface 35 reduces flow of oil to the piston/cylinder liner interface while still providing adequate lubrication and associated hardware protection. This may result in a reduction in hydrodynamic lubrication drag related losses and associated improvements in fuel economy. Controlling oil flowrate to the oil jet(s) 38 in response to temperature of the internal engine surface 35 may reduce engine-out hydrocarbon concentrations and a reduction in engine-out NOx concentrations at low temperatures. Controlling oil flowrate to the oil jet(s) 38 in response to temperature of the internal engine surface 35 may reduce a minimum torque to start an engine at low temperature, permitting reduction in battery size and/or improving engine cold startability.

The disclosure has described certain preferred embodiments and modifications thereto. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A lubrication system for an internal combustion engine, comprising:

an oil jet configured to communicate oil onto an internal engine surface;

the oil jet fluidly connected to a pressurized oil source via an oil flow controller comprising a thermo-sensitive flow control valve including at least a first temperature-responsive bimetallic spring and a second temperature-responsive bimetallic spring; and the oil flow controller configured to control oil flowrate directly from the pressurized oil source to the oil jet, independent of an oil pressure from the pressurized oil source, such that the oil flowrate to the oil jet is controlled to increase only in response to an actual temperature of the internal engine surface increasing and to decrease only in response to the actual temperature of the internal engine surface decreasing, said first and second temperature-responsive bimetallic springs of the thermo-sensitive flow control valve configured to position a plunger in relation to a valve seat in response to the actual temperature of the internal engine surface, said first temperature-responsive bimetallic spring configured to urge the plunger towards the valve seat and said second temperature-responsive bimetallic spring configured to urge the plunger away from the valve seat to allow:

a maximum oil flowrate to flow through the thermo-sensitive flow control valve to the oil jet when the actual temperature of the internal engine surface is increased to a value that is at least an upper threshold temperature indicative of a maximum allowable operating temperature of the internal engine surface, a reduced oil flowrate to flow through the thermo-sensitive flow control valve to the oil jet when the actual temperature of the internal engine surface is less than the upper threshold temperature and greater than a lower threshold temperature, and a discontinued oil flowrate through the thermo-sensitive flow control valve when the actual temperature of the internal engine surface is decreased to a value that is less than the lower threshold temperature.

2. The lubrication system of claim 1, wherein the internal engine surface comprises an underside of a reciprocating piston.

3. The lubrication system of claim 1, wherein the thermo-sensitive flow control valve is thermally coupled to an engine block.

4. The lubrication system of claim 1, wherein the oil flow controller is configured to control the oil flowrate to the oil jet in response to a proxy for the temperature of the internal engine surface.

5. The lubrication system of claim 4, wherein the oil flow controller is configured to control the oil flowrate to the oil jet in response to engine oil temperature.

6. The lubrication system of claim 4, wherein the oil flow controller is configured to control the oil flowrate to the oil jet in response to engine oil temperature and engine block temperature.

7. The lubrication system of claim 1, wherein the oil flow controller is configured to variably control the oil flowrate to the oil jet in response to the temperature of the internal engine surface.

8. The lubrication system of claim 1, wherein the oil flow controller is configured to discretely control the oil flowrate to the oil jet in response to the temperature of the internal engine surface.

9. A lubrication system, comprising:

an oil jet configured to spray oil onto an internal engine surface; and an oil flow controller comprising a thermo-sensitive flow control valve including at least a first temperature-responsive bimetallic spring and a second temperature-responsive bimetallic spring, the oil flow controller configured to control a flowrate of oil directly from a pressurized oil source through the thermo-sensitive flow control valve to the oil jet, independent of an oil pressure from the pressurized oil source, such that the oil flowrate to the oil jet is controlled to increase only in response to an actual temperature of the internal engine surface increasing and to decrease only in response to the actual temperature of the internal engine surface decreasing, said first and second temperature-responsive bimetallic springs of the thermo-sensitive flow control valve configured to position a plunger in relation to a valve seat in response to the actual temperature of the internal engine surface, said first temperature-responsive bimetallic spring configured to urge the plunger towards the valve seat and said second temperature-responsive bimetallic spring configured to urge the plunger away from the valve seat to allow:

a maximum oil flowrate to flow through the thermo-sensitive flow control valve to the oil jet when the actual temperature of the internal engine surface is increased to a value that is at least an upper threshold temperature indicative of a maximum allowable operating temperature of the internal engine surface, a reduced oil flowrate to flow through the thermo-sensitive flow control valve to the oil jet when the actual temperature of the internal engine surface is less than the upper threshold temperature and greater than a lower threshold temperature, and a discontinued oil flowrate through the thermo-sensitive flow control valve when the actual temperature of the internal engine surface is decreased to a value that is less than the lower threshold temperature.

10. The lubrication system of claim 9, wherein the internal engine surface comprises an underside of a reciprocating piston.

11. The lubrication system of claim 9, wherein the thermo-sensitive flow control valve is thermally coupled to an engine block.

12. The lubrication system of claim 9, wherein the oil flow controller is configured to control the oil flowrate to the oil jet in response to a proxy for the temperature of the internal engine surface.

13. The lubrication system of claim 12, wherein the oil flow controller is configured to control the oil flowrate to the oil jet in response to engine oil temperature.

14. The lubrication system of claim 12, wherein the oil flow controller is configured to control the oil flowrate to the oil jet in response to engine oil temperature and engine block temperature.

15. The lubrication system of claim 12, wherein the oil flow controller is configured to variably control the oil flowrate to the oil jet in response to the temperature of the internal engine surface.

16. The lubrication system of claim 12, wherein the oil flow controller is configured to discretely control the oil flowrate to the oil jet in response to the temperature of the internal engine surface.

* * * * *